US006109969A

United States Patent [19]

Kuo et al.

[11] Patent Number: 6,109,969

[45] Date of Patent: Aug. 29, 2000

[54] CABLE CONNECTOR HAVING IMPROVED EMI SHIELDS FOR SECURELY GROUNDING TO A PANEL OF A MATING CONNECTOR

[75] Inventors: Peter Kuo, Chung-Ho; Ji-Cheng Lee, Taipei, both of Taiwan

[73] Assignee: Hon Hai Precision Ind. Co., Ltd., Taipei Hsien, Taiwan

[21] Appl. No.: 09/290,769

[22] Filed: Apr. 13, 1999

[30] Foreign Application Priority Data

Apr. 13, 1998 [TW] Taiwan ..... 87205642

[51] Int. Cl.[7] ..... H01R 9/03

[52] U.S. Cl. ..... 439/610

[58] Field of Search ..... 439/607, 609, 439/610, 901, 906, 939

[56] References Cited

U.S. PATENT DOCUMENTS

| | | | |
|---|---|---|---|
| 4,449,778 | 5/1984 | Lane | 439/610 |
| 5,696,669 | 12/1997 | Bassler | 439/607 |
| 5,836,774 | 11/1996 | Tan | 439/610 |
| 5,967,845 | 12/1997 | Ho | 439/607 |
| 5,984,725 | 4/1997 | Belopolsky | 439/607 |
| 6,007,385 | 3/1998 | Wu | 439/610 |

*Primary Examiner*—Lincoln Donovan
*Assistant Examiner*—Javaid Nasri
*Attorney, Agent, or Firm*—Wei Te Chung

[57] ABSTRACT

An EMI shield for use with a cable connector comprises an extension extending from a front portion of the shield. A mating face orthogonal to a horizontal direction of the shield is formed at an end of the extension. The mating face forms a plurality of contacting buds thereon.

11 Claims, 4 Drawing Sheets

CABLE CONNECTOR HAVING IMPROVED EMI SHIELDS FOR SECURELY GROUNDING TO A PANEL OF A MATING CONNECTOR

FIELD OF THE INVENTOR

The present invention relates to a cable connector, and more particularly to a cable connector having an EMI shield for facilitating efficient signal transmission therethrough.

DESCRIPTION OF PRIOR ART

Cable connectors are assembled to ends of a cable which facilitates signal transmission between two computer systems. For example, a notebook computer requires a cable to electrically connect with an external floppy disk drive or a printer. Since the cable connector is directly connected to a complimentary connector of the computer system, an EMI shielding effect must be considered in the design of the cable connector.

SUMMARY OF THE INVENTION

An objective of the present invention is to provide a cable connector having a better EMI shielding effect to ensure efficient signal transmission therethrough.

In order to achieve the objective set forth, a cable connector in accordance with the present invention generally comprises a housing defining a receiving chamber therein. The housing forms a mating portion for attaching to a mating connector and a rear portion through which a cable is directed. The cable is electrically connected with the connector by means of a printed circuit. An EMI bracket is arranged within the receiving chamber and a portion of the bracket extends beyond the mating portion of the housing.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
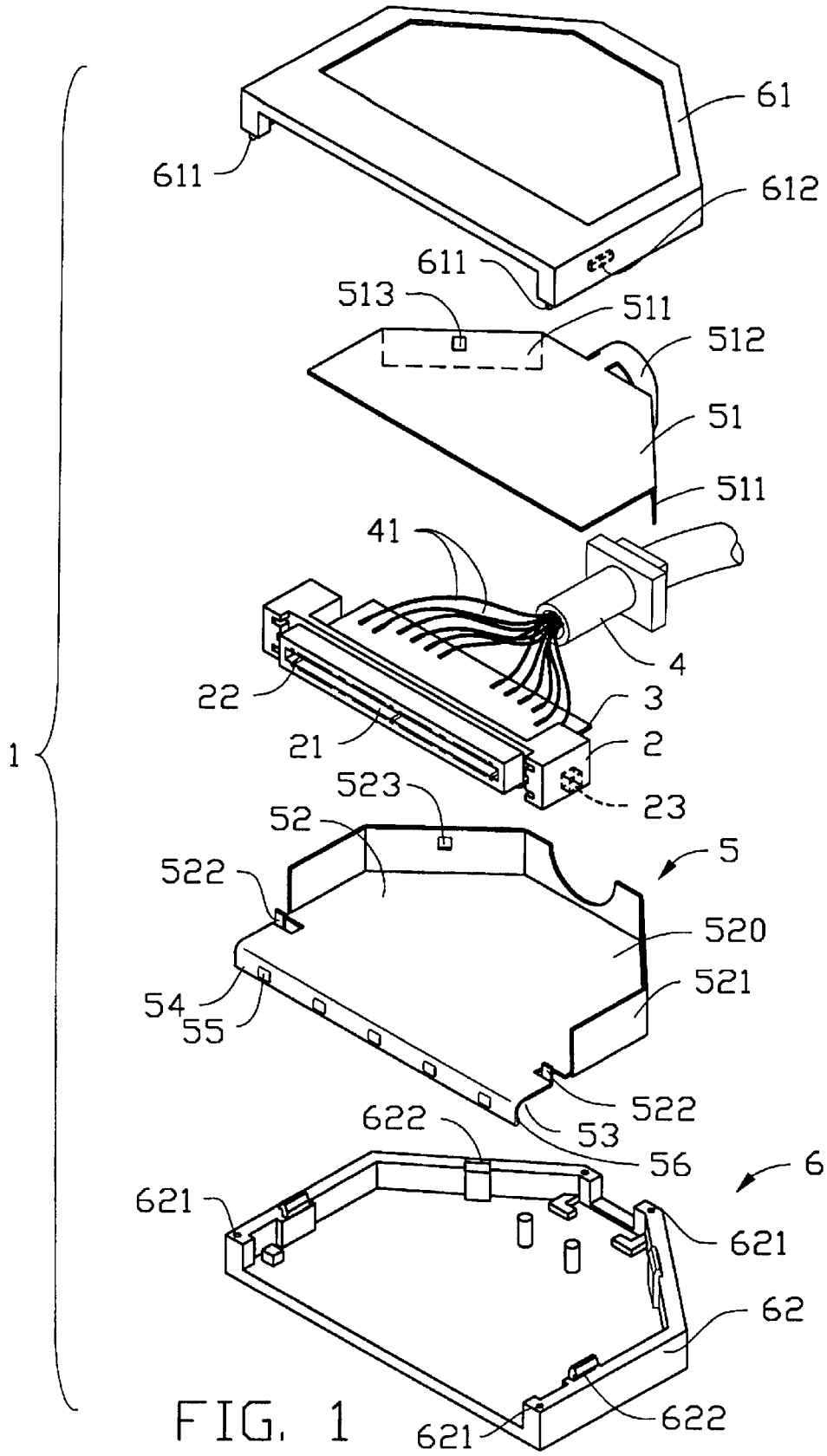
FIG. 1 is an exploded, perspective view of a cable connector in accordance with the present invention.

Referring to FIGS. 1, 1A, 2 and 3, a cable connector 1 in accordance with the present invention generally comprises an elongate insulative housing 2, a printed circuit board 3, a cable 4, an EMI shield 5, and an outer insulate shell 6. The housing 2 defines a receiving groove 21 in a front portion thereof for matably receiving a male connector (not shown). The receiving groove 21 defines a plurality of passageways 22 each receiving a terminal (not shown) therein. The housing 2 forms a connecting groove (not shown) for retaining the printed circuit board 3 therein. The printed circuit board 3 is electrically connected with the terminals.

Figure 1A:
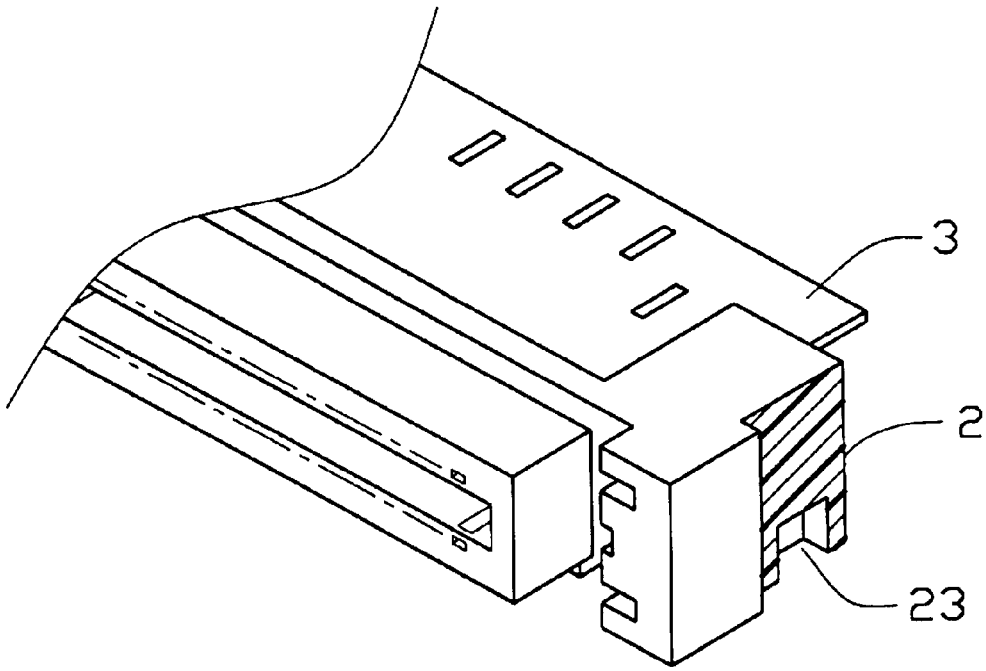
FIG. 1A is an enlarged perspective view of a housing and a circuit board of FIG. 1, wherein a part of the housing is cut away.
Figure 2:
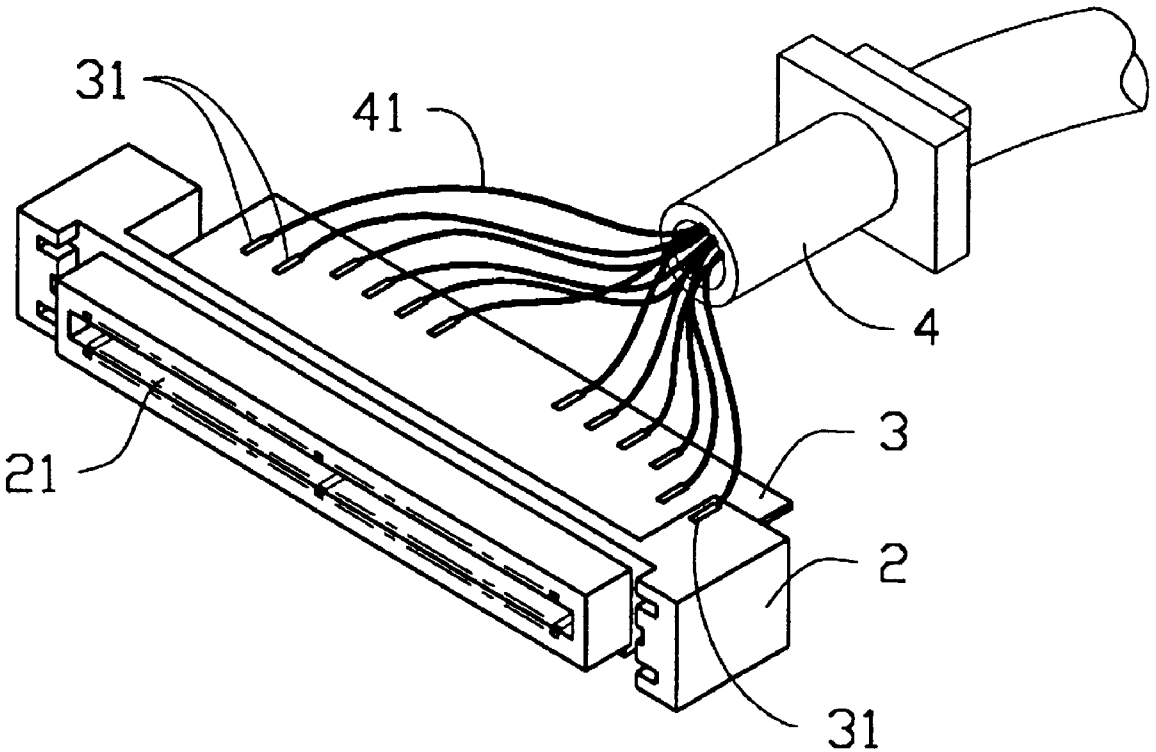
FIG. 2 is a partial, assembled view of the cable connector in which a housing and a EMI bracket are removed for clarity.
Figure 3:
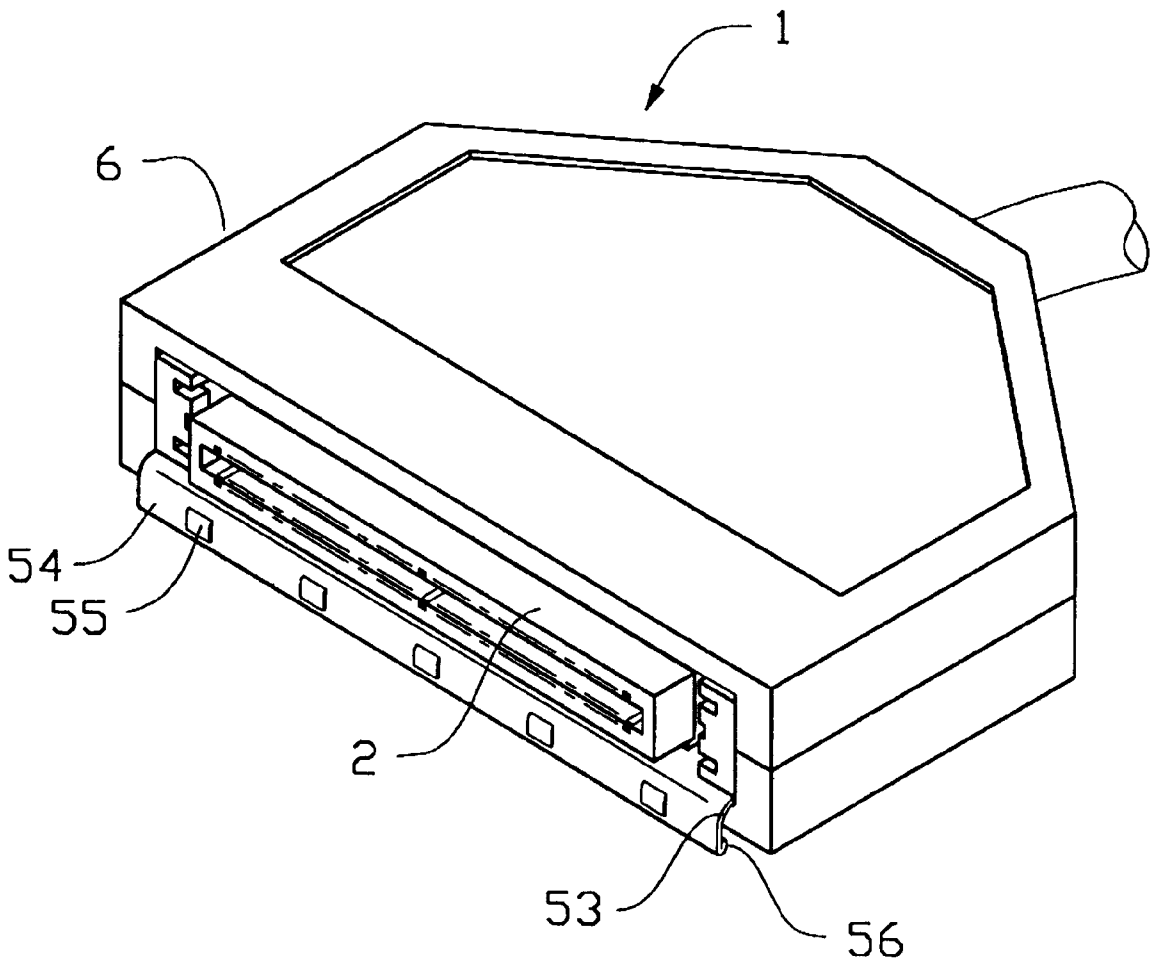
FIG. 3 is an assembled view of the cable connector of FIG. 1.

The housing 2 further defines a pair of retaining slots 23 in the bottom surface thereof (FIG. 1A). The cable 4 includes a plurality of conductors 41 each connecting with a corresponding trace 31 of the printed circuit board 3, as shown in FIG. 2.

The EMI shield 5 includes an upper half 51 and a lower half 52. The upper half 51 forms a pair of retaining tabs 511 each defining a retaining hole 513 therethrough. The shield 5 further includes a clip 512 located between the retaining tabs 511. The clip 512 is used to securely position the cable 4 during assembly. The lower half 52 forms a peripheral wall 521 extending along traverse sides thereof. The wall 521 is formed with a pair of projections 523 for engaging with the corresponding retaining holes 513 of the tabs 511. The lower half 52 further includes a pair of positioning tabs 522 for engaging with the corresponding retaining slots 23 of the housing 2.

Referring particularly to FIG. 1, the lower half 52 includes a body portion 520 and an extension 53 forwardly extending from a front edge of the body portion 520. The extension 53 has a mating face 54 at a front end thereof, said mating face 54 extending generally perpendicular to the body portion 520 in a direction opposite to the direction the peripheral wall 521 extends. The mating face 54 forms a plurality of contacting buds 55 embossed thereon and protruding forwardly therebeyond for electrically engaging with a panel to which the male connector (not shown) is mounted, thereby establishing a grounding path between the EMI shield 5 and the grounding panel. The extension 53 further forms a curved rim 56 extending rearward and then upward from a bottom end of the mating face 54. A free end of the curved rim 56 is generally parallel to the mating face 54. The cured rim 56 strengthens the mating face 54, thereby assuring a reliable engagement between the contacting buds 55 and the panel of the male connector.

The outer shell 6 includes an upper shell 61 and a lower shell 62 for enclosing the above-described elements therein. The upper shell 61 is formed with a plurality of dowel pins 611 and retaining notches 612. The lower shell 61 is formed with a mounting hole 621 corresponding to each dowel pin 611, and a retaining wedge 622 for engaging with the corresponding retaining notch 612 of the upper shell 61.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

We claim:

1. The cable connector comprising:

an elongate insulative housing defining a receiving groove in a front portion thereof for receiving a mating connector, said receiving groove defining a plurality of passageways each receiving a terminal therein, said housing defining a connecting groove in a rear portion thereof;

a printed circuit board received within said connecting groove and electrically connecting with said terminals;

a cable electrically connecting with said printed circuit board;

an EMI shield enclosing said housing, said EMI shield having a body portion on one side thereof and an extension protruding forward from a front end of the body portion, said extension forming a mating face projecting outward from a front end of the extension and being perpendicular to the body portion of said shield, a plurality of buds being formed on the mating face and protruding forward beyond the mating face for electrically engaging with a grounding panel of the mating connector, thereby establish a grounding path therebetween; and an outer shell for enclosing said EMI shield.

2. The cable connector as recited in claim 1, wherein said mating face forms a curved rim on an edge thereof.

3. The cable connector as recited in claim 1, wherein said EMI shield includes an upper half and a lower half.

4. The cable connector as recited in claim 3, wherein said upper half and said lower half of said shield are provided with a retaining hole and a projection arrangement for engaging with each other.

5. The cable connector as recited in claim 4, wherein said extension of EMI shield extends vertically outside said cable connector and is adjacent to said receiving groove.

6. The cable connector as recited in claim 1, wherein said EMI shield includes at least a positioning tab for engaging with a corresponding retaining slot of said housing.

7. The cable connector as recited in claim 1, wherein said outer shell includes an upper shell and a lower shell.

8. The cable connector as recited in claim 1, wherein said buds are embossed on the mating face.

9. An EMI shield for use with a cable connector comprising:

a body portion; and an extension extending from a front side of said body portion;

said extension having a mating face projecting from a front end thereof and perpendicularly away from the body portion, the mating face forming a plurality of buds embossed thereon, the buds forwardly protruding beyond the mating face for electrically engaging with a grounding panel of a mating connector for establishing a grounding path therebetween.

10. The EMI shield as recited in claim 9, wherein said mating face forms a curved rim on an edge thereof.

11. A cable connector comprising:

an elongate insulative housing defining a receiving groove in a front portion thereof for receiving a mating connector, said receiving groove defining a plurality of passageways each receiving a terminal therein, said housing defining a connecting groove in a rear portion thereof;

a printed circuit board received within said connecting groove and electrically connecting with said terminals;

a cable electrically connecting with said printed circuit board;

an EMI shield comprising an upper half and a lower half, each half having a body portion enclosing said housing, the lower half further having an extension forwardly extending from a front end of the body portion thereof, the extension forming a mating face projecting outward from the front end thereof and being generally perpendicular to said body portion, the extension further forming a curved rim extending rearward and then upward from a bottom end of the mating face to strengthen the mating face, for assuring a reliable engagement between the mating face and a grounding panel of the male connector; and an outer shell for enclosing said EMI shield.

* * * * *